US005641206A

United States Patent [19]

Craft

[11] Patent Number: 5,641,206

[45] Date of Patent: Jun. 24, 1997

[54] APPARATUS FOR REMOVING A SURFACE LAYER FROM A FLOOR OR THE LIKE

[75] Inventor: David B. Craft, Soap Lake, Wash.

[73] Assignee: Innovatech Products & Equipment Co., Bothell, Wash.

[21] Appl. No.: 516,154

[22] Filed: Aug. 17, 1995

[51] Int. Cl.[6] ..... B32B 31/18

[52] U.S. Cl. ..... 299/37.1; 30/169

[58] Field of Search ..... 299/36.1, 37.1, 299/37.2, 37.3, 37.4, 37.5; 30/169, 170

[56] References Cited

U.S. PATENT DOCUMENTS

| | | | |
|---|---|---|---|
| 4,365,843 | 12/1982 | Grasse | 299/37.1 |
| 4,504,093 | 3/1985 | Grasse | 299/37.1 |
| 5,002,629 | 3/1991 | Nakamura | 299/87.1 X |
| 5,037,160 | 8/1991 | Ukai | 299/37.1 |
| 5,082,330 | 1/1992 | Holder | 299/37.1 |
| 5,197,784 | 3/1993 | Holder | 299/37.1 |

*Primary Examiner*—Frank Tsay
*Attorney, Agent, or Firm*—Graybeal Jackson Haley LLP

[57] ABSTRACT

An apparatus for removing at least one surface layer from a floor or the like comprises a machine body having a longitudinal axis, rear weight-bearing guide wheels, and a front weight-bearing wheel. A front weight-bearing scraping apparatus is pivotable with respect to the machine body by a cylinder located between the machine body and the front weight-bearing scraping apparatus. The machine body is thus configurable between a first machine transport position in which the front weight-bearing wheel contacts the surface being scraped and the front weight-bearing scraping apparatus is elevated from the surface being scraped and the longitudinal axis of the machine body is substantially parallel with the horizontal plane of the surface being scraped; and a second surface-scraping position in which the front weight-bearing wheel is elevated from the surface being scraped and the front weight-bearing scraping apparatus contacts the surface being scraped and the longitudinal axis of the machine body is aparallel to the horizontal plane of the surface being scraped.

24 Claims, 17 Drawing Sheets

0
10
20
18
14
12
22
16
30
28
26
24
34
36
32
40
38
42
102
94
52
50
80
84
82
88
86
90
78
48
62
58
60
128
64
56
54

FIG. 16
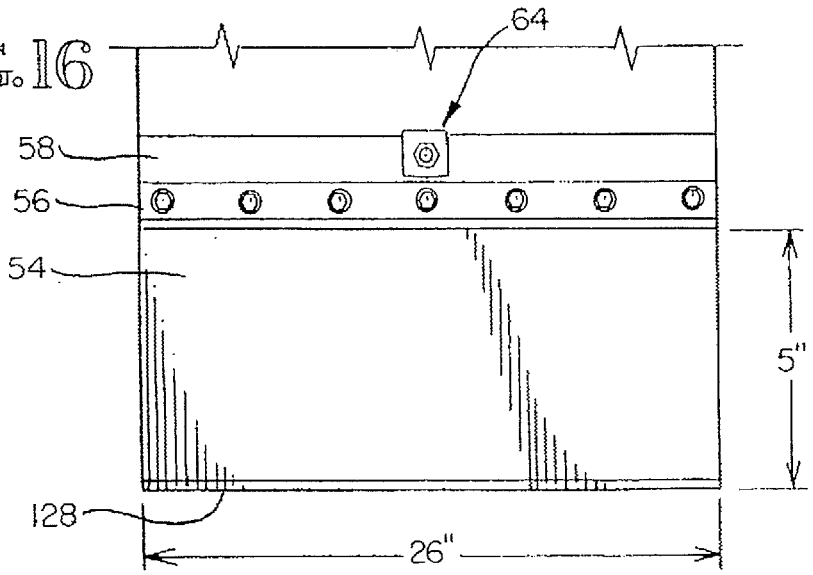
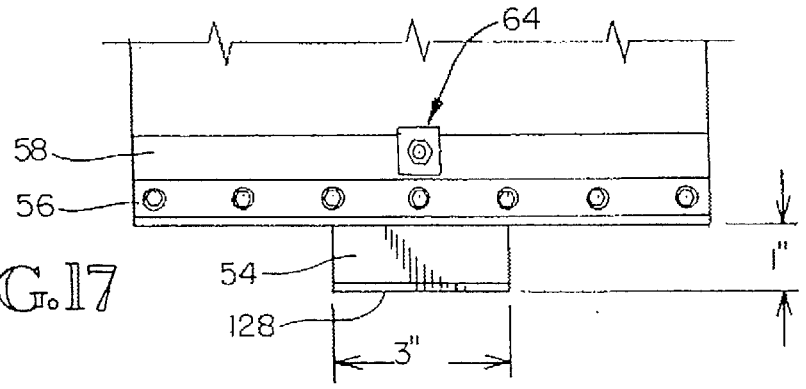
FIG. 17
FIG. 18
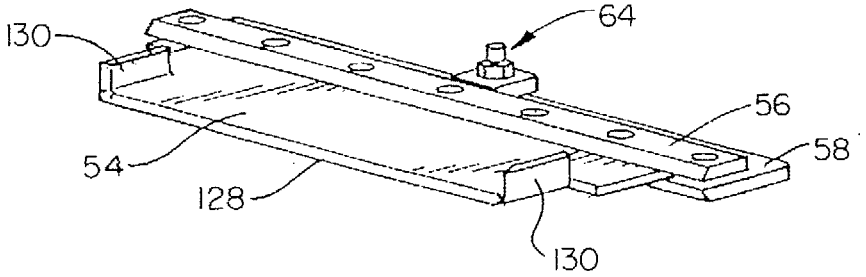

FIG. 23
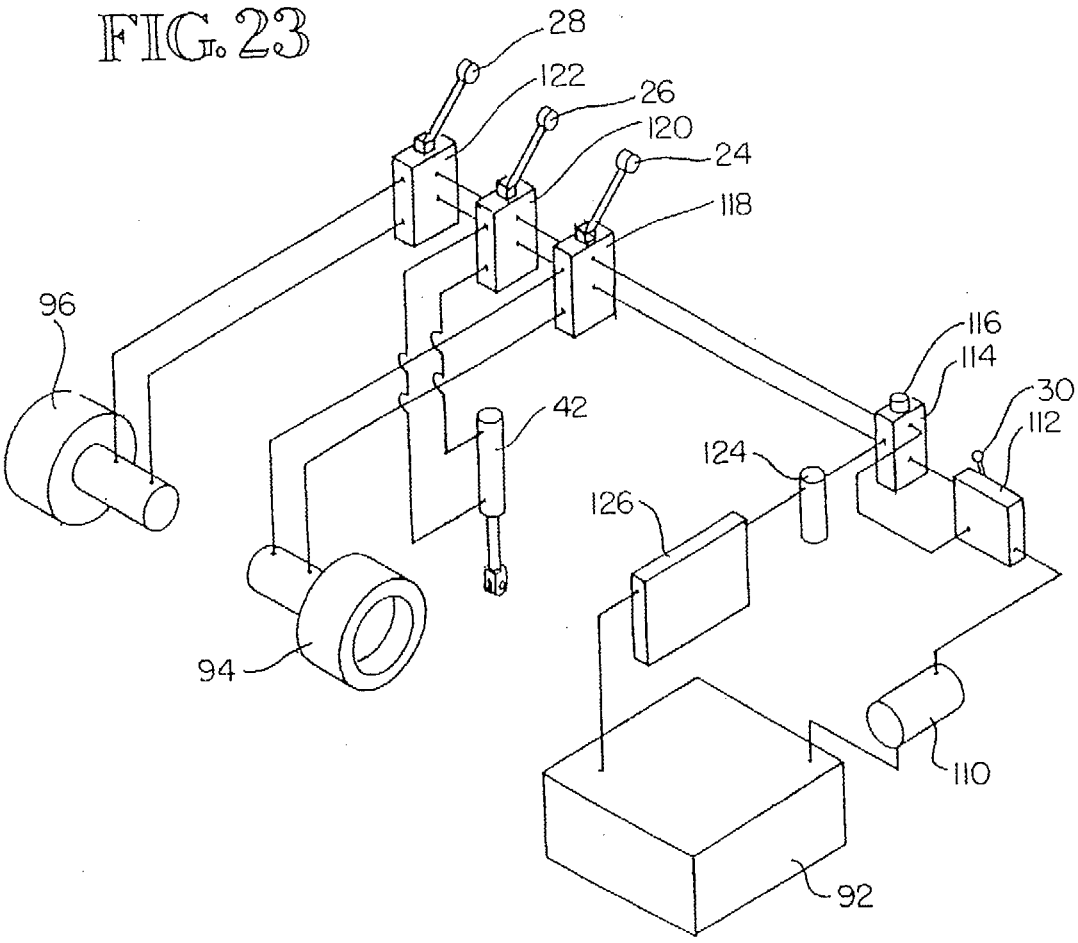
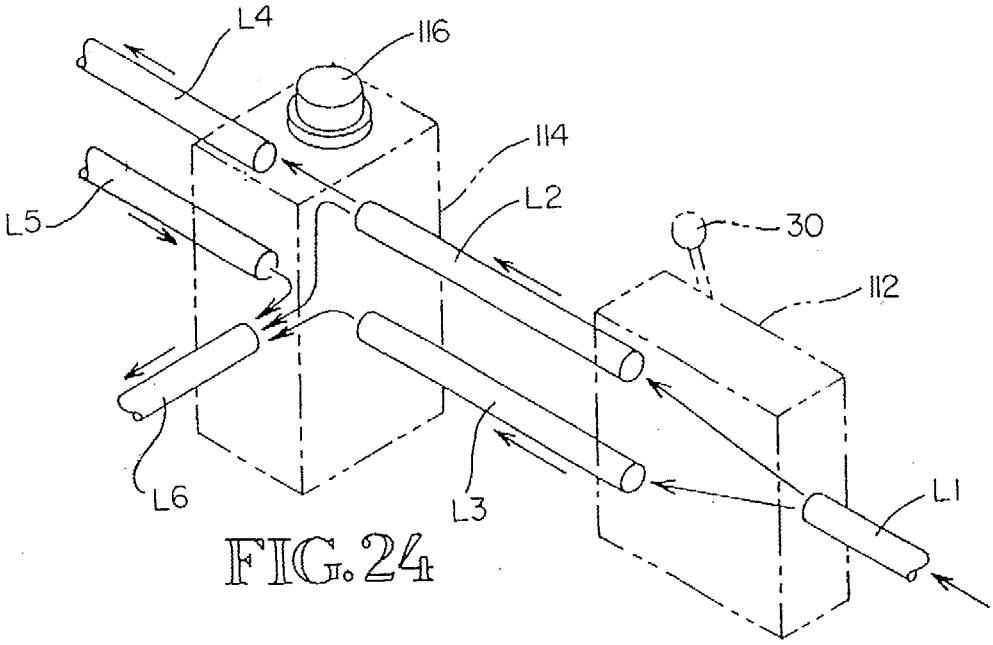
FIG. 24

APPARATUS FOR REMOVING A SURFACE LAYER FROM A FLOOR OR THE LIKE

BACKGROUND OF THE INVENTION

The present invention generally pertains to machines for removing at least one surface layer from a floor or the like. It will be understood that the one or more surface layers which are removable by the apparatus of the present invention include, but are not limited to, carpet, vinyl tile, vinyl sheet goods, hardwood planking, hardwood parquet, elastomeric coatings, soft surface sports coatings, ceramic tiles, marble, slate, grout, porcelain and epoxy resin. Surface coatings of the above types are generally found in, for example, homes, office buildings, stores, sports arenas, malls, or the like.

When any of the above types of buildings are renovated, or when a new floor layer is required under any circumstances, it is first desired, if not absolutely required, to remove the pre-existing floor covering. The removal of floor coverings is an arduous task because the existing floor coverings are securely fixed to the base surface such that the covering does not come unattached during its useful life. Numerous types of physical attachment devices, such as nails or screws, as well as chemical adhesives, such as thermo-setting resin and epoxy resin, are employed to affix the floor cover to the underlying surface. Thus, when a floor covering is to be removed, the mechanism which adheres the floor covering to the underlying surface, usually an adhesive, must also be removed such that a clean surface is present for the application of the new floor covering. However, the strength of the adhesive not only hinders removal of the adhesive, but often results in incomplete removal of the floor covering in which a portion of the floor covering remains adhered to the underlying surface by the adhesive, resulting in a patchwork effect.

Human hand labor is the first, and most inefficient, means of removing floor coverings. Humans do not possess the strength necessary to remove floor coverings in most circumstances, even with hand tools. Hand operated machines have been employed which grind or abrade the floor covering and connecting adhesive from the underlying surface. However, these powered devices are dangerous in that the high-speed vibrating portion of the mechanism can injure the worker, and the particulate matter created by the grinding process is injurious to workers' respiratory systems. Additionally, these hand-held devices do not completely remove the floor covering and underlying adhesive because the power source, which is limited by the relatively small size of the hand-held device, is insufficient for the task.

Larger machines have also been employed in which the machine is hydraulically powered by a hydraulic power source located at a distance. The cables associated with the hydraulic power source are cumbersome, and these machines, as with the hand-held machines, generally attempt to grind or abrade the floor covering and adhesive from the underlying floor surface, which results in the dissemination of unhealthful particulate matter. Furthermore, grinding or abrading is a time-consuming and inefficient method of removing the surface layer and underlying adhesive because not only must the entire floor area be travelled (width times length), but the entire depth of the surface covering and adhesive must also be traversed.

While machines are generally known for scraping one or more surface layers from an underlying layer, such as road levellers and the like, these devices are entirely inappropriate for use on floor covering and underlying adhesives.

These devices lack the combination of compact size, economy of use and efficiency of operation to be time and cost effective.

A need thus exists for an apparatus for removing at least one surface layer from a floor or the like by-forcing a blade member between the layer or layers to be removed and the underlying layers with the application of sufficient force.

A need further exists for the above type of apparatus in which the apparatus is configurable between a first machine transport position for movement of the apparatus from location to location, and a second surface scraping position in which one or more surface layers are removed from the underlying floor.

A need further exists for the above type of apparatus in which the relative mass over the blade of the apparatus and the relative mass over the driving wheels of the apparatus can be altered to achieve the optimum desired mass balance of the apparatus.

A need also exists for the above type of apparatus in which the position of the portion of the apparatus supporting the blade can be altered with respect to the horizontal to provide a first degree of adjustment.

A need further exists for the above type of apparatus in which the blade, itself, can be angled with respect to horizontal to provide a second degree of adjustment, such that the angle of attack of the blade with respect to the surface being removed can be precisely controlled.

Finally, a need exists for the above type of apparatus in which the apparatus is mountable by a machine operator during use.

SUMMARY OF THE INVENTION

An apparatus for removing at least one surface layer from a floor or the like comprises a machine body having a longitudinal axis, rear weight-bearing guide wheels, and a front weight-bearing wheel. A front weight-bearing scraping apparatus is pivotable with respect to the machine body by a cylinder located between the machine body and the front weight-bearing scraping apparatus. The machine body is thus configurable between a first machine transport position in which the front weight-bearing wheel contacts the surface being scraped and the front weight-bearing scraping apparatus is elevated from the surface being scraped and the longitudinal axis of the machine body is substantially parallel with the horizontal plane of the surface being scraped; and a second surface-scraping position in which the front weight-bearing wheel is elevated from the surface being scraped and the front weight-bearing scraping apparatus contacts the surface being scraped and the longitudinal axis of the machine body is aparallel to the horizontal plane of the surface being scraped.

Most preferably, the machine body has a rear portion with a plurality of removable weights located thereon and the front weight-bearing scraping apparatus also has a plurality of removable weights located thereon. In this manner, the mass balance of the machine can be optimized such that sufficient mass is present on the front weight-bearing scraping apparatus, allowing the front weight-bearing scraping apparatus to penetrate the surface to be scraped, and such that sufficient mass is present on the rear portion of the machine body for the rear weight-bearing drive wheels to maintain contact and traction with the ground during scraping.

The front weight-bearing scraping apparatus most preferably comprises a support plate pivotally attached to the machine body at a first location thereon with a hydraulic cylinder being connected between the machine body and the support plate, and the support plate having a scraping blade attached thereto. Optionally, the support plate is adjustable between this first pivot location on the machine body and the second pivot location such that the distance of the support plate from the scraping surface can be altered. The front weight-bearing scraping apparatus can also include a mechanism for pivotally attaching the blade to the support plate, which comprises a blade attachment plate pivotally attached to an end of the support plate, a wedge slidably mounted on the support plate and oriented to fit under a portion of the blade attachment plate to bias the blade attachment plate at a predetermined angle from horizontal, and a bolt which passes through the blade attachment plate and is securable with a nut such that the blade attachment plate is held between the nut and the wedge.

Most preferably, the scraping blade is a planar member having a front scraping portion connected to two side portions, with the two side portions being substantially perpendicular to the horizontal plane of the scraping blade.

BRIEF DESCRIPTION OF THE DRAWINGS

These and other features of the present invention will be more fully appreciated when considered in light of the following specification and drawings in which:

FIG. 16 is an enlarged top view of a first blade for use with the surface-removing machine of the present invention;

FIG. 17 is an enlarged top view of a second blade for use with the surface-removing machine of the present invention;

FIG. 18 is an enlarged perspective view of a blade having wings for use with the surface-removing machine of the present invention;

FIG. 23 is a schematic diagram of the hydraulic system of the surface-removing machine of the present invention; and FIG. 24 is an enlarged schematic diagram of the variable flow controller and volume flow divider of the hydraulic system of the surface-removing machine of the present invention.

DETAILED DESCRIPTION OF THE PREFERRED EMBODIMENTS

Figure 1:
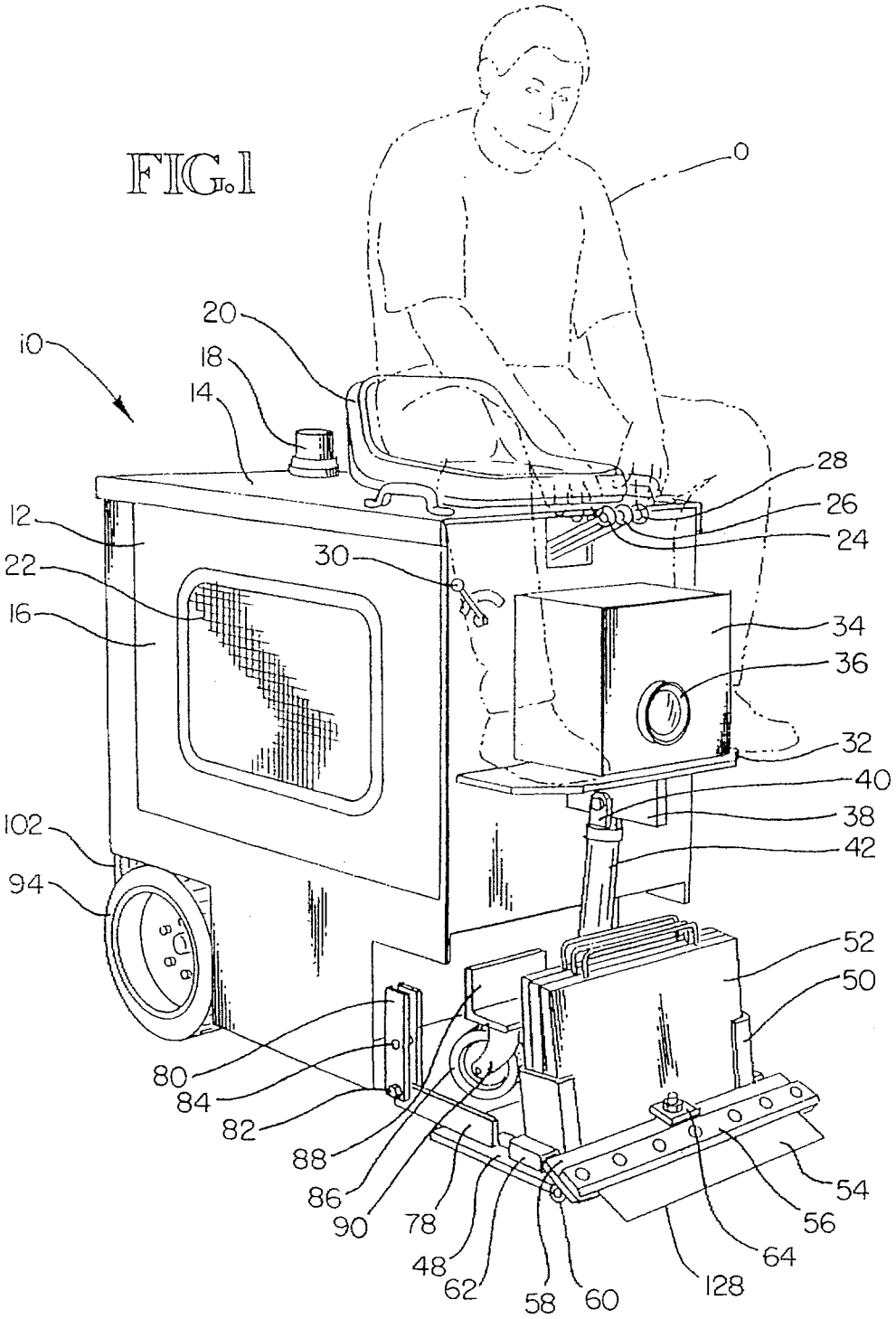
FIG. 1 is a perspective view taken from the front of the surface-removing machine of the present invention.
Figure 2:
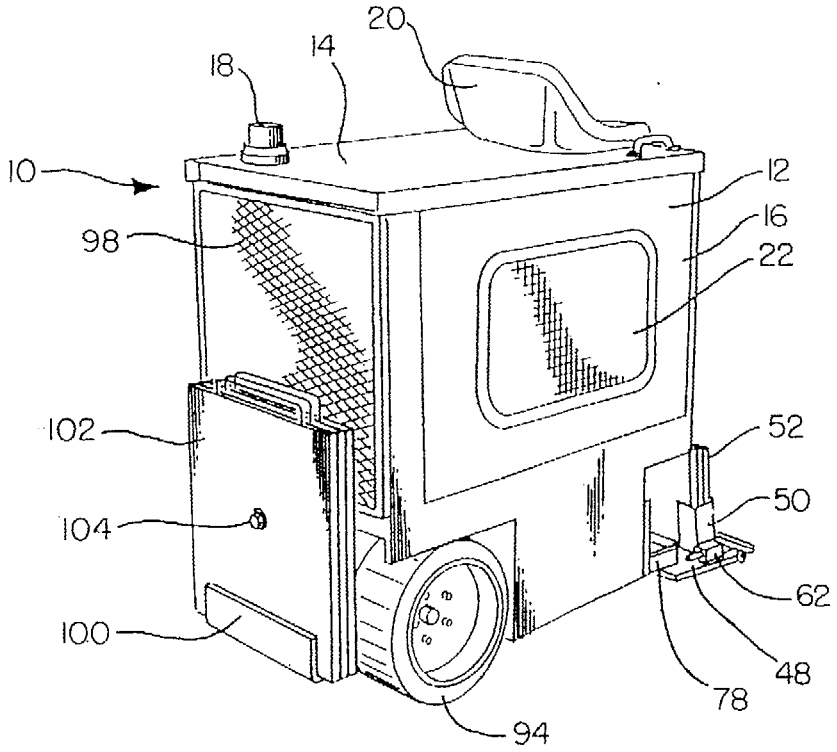
FIG. 2 is a perspective view taken from the back of the surface-removing machine of the present invention.

The present invention pertains to an apparatus for removing at least one surface layer from a floor or the like. It will be understood that the one or more surface layers which are removable by the apparatus of the present invention include, but are not limited to, carpet, vinyl tile, vinyl sheet goods, hardwood planking, hardwood parquet, elastomeric coatings, soft surface sports coatings, ceramic tiles, marble, slate, grout, porcelain and epoxy resin. Referring to FIGS. 1–25 in general, and specifically referring to FIGS. 1 through 5, surface-removing machine 10 includes machine body 12 having top 14 and sides 16 with backup safety light 18 and operator seat 20 located on top 14 of machine body 12. Sides 16 have ventilation grills 22 located thereon. It is important that operator 0 can sit in seat 20 during operation of surface-removing machine 10. When seated in seated in seat 20, operator 0 can readily access right wheel control lever 24, scraper position control level 26, left wheel control lever 28 and hydraulic power control lever 30, all located on machine body 12. Foot plate 32 provides additional support for operator 0 and also has instrument gauge box 34 attached thereto. Instrument gauge box 34 houses a plurality of instrument gauges (not shown) on the top thereof for view by operator 0. On the front of instrument gauge box 34 is light 36, which allows surface-removing machine 10 to be operated in buildings under construction or remodel where the building light sources are not functional.

Figure 3:
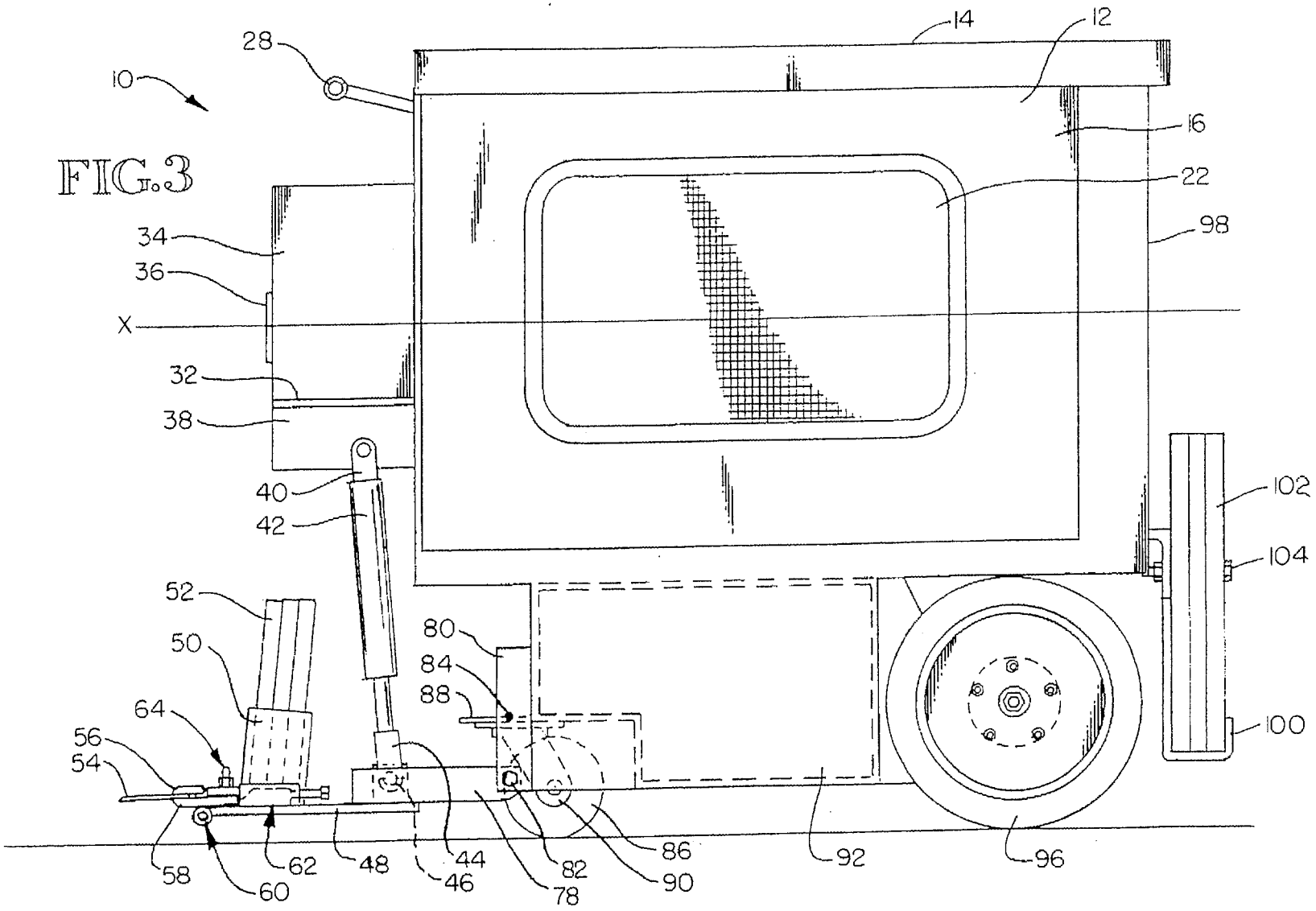
FIG. 3 is a side elevational view of the surface-removing machine of the present invention in its machine transport position.

Hydraulic cylinder support 38 is located on the underside of foot plate 32 and attaches to upper flange 40 of hydraulic cylinder 42. Lower flange 44 of hydraulic cylinder 42, as shown in FIG. 3, is secured to scraper support plate 48 by pivot 46 such that, upon extension and retraction of hydraulic cylinder 42, scraper support plate 48 pivots relative to the horizontal plane of the surface being removed, as described further below. Brackets 50 are located on top of scraper support plate 48 and house front weight plates 52. Front weight plates 52 are a plurality of individually removable mass bodies which are added to, or subtracted from, scraper support plate 48 in order to acquire the desired amount of mass on scraper support plate 48 such that sufficient penetration of the surface layer being removed is attained by blade 54. Blade 54 is located between upper blade attachment plate 56 and lower blade attachment plate 58. Lower blade attachment plate 58 is connected to pivot point 60 on scraper support plate 48. Pivot point 60 provides a second degree of horizontal motion in addition to the aforesaid horizontal pivoting of scraper support plate 48 as hydraulic cylinder 42 is actuated. In order to ensure that blade 54, upper blade attachment plate 56 and lower blade attachment plate 58 remain in the desired orientation relative to horizontal, wedge mechanism 62 fits under a portion of lower blade attachment plate 58 and securing mechanism 64 contacts upper blade attachment plate 56 such that blade 54, upper blade attachment plate 56 and lower blade attachment plate 58 are secured between wedge mechanism 62 and securing mechanism 64.

Figure 6:
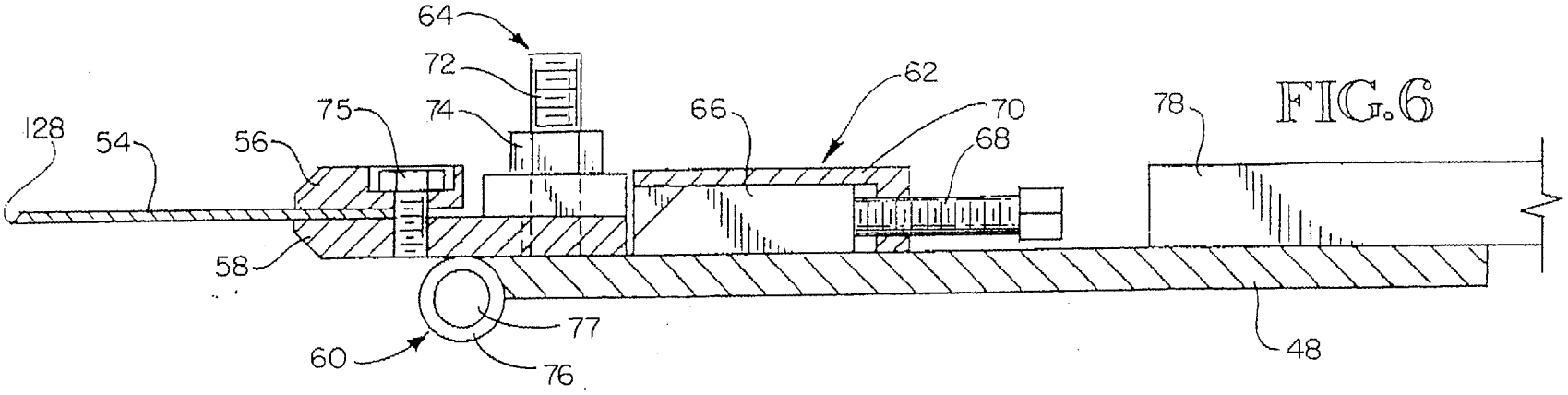
FIG. 6 is a side view, partially exposed, of the scraper support plate and blade of the present invention in a first configuration.
Figure 7:
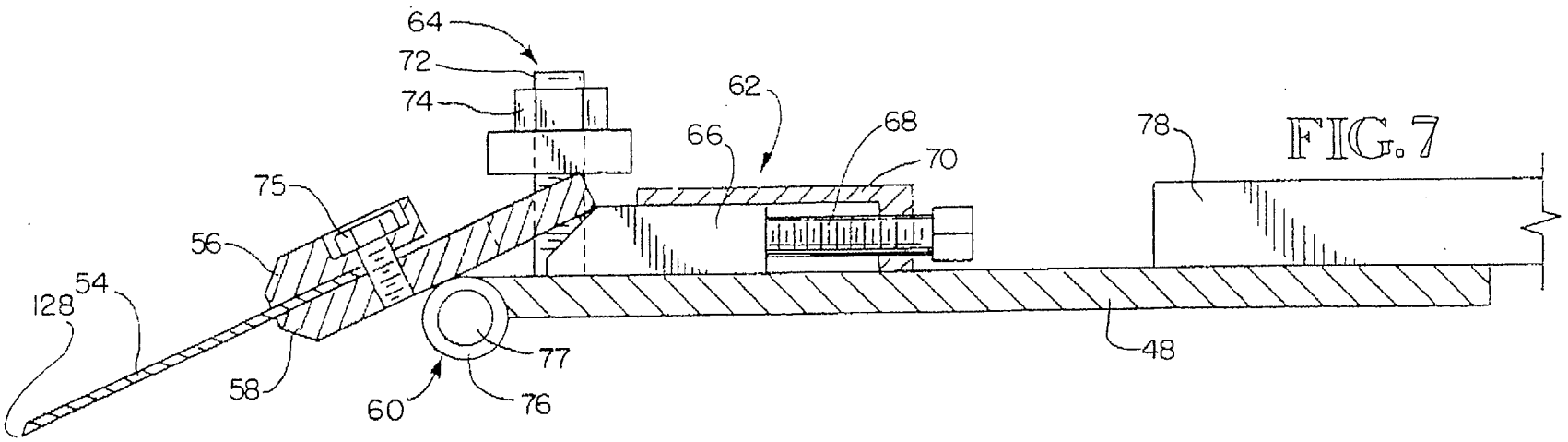
FIG. 7 is a side view, partially exposed, of the scraper support plate and blade of the present invention in a second configuration.

More specifically, referring to FIGS. 6 and 7, wedge mechanism 62 is comprised of wedge 66 having bolt 68 in an end thereof such that bolt 68 can rotate with respect to wedge 66. L-bracket 70 houses wedge 66 and threadedly receives bolt 68 such that rotation of bolt 68 through L-bracket 70 results in sliding movement of wedge 66 along scraper support plate 48 whereby the nose portion of wedge 66 passes under lower blade attachment plate 58. Threaded rod 72 is attached to scraper support plate 48 and passes through lower blade attachment plate 58. Tightening of nut 74 onto threaded rod 72 thus secures lower blade attachment plate 58 between wedge 66 and nut 74 in order to ensure that blade 54 is maintained in the desired angle from horizontal. Rotation of blade 54, upper blade attachment plate 56 and lower blade attachment plate 58 around horizontal is accomplished by pivot point 62, as stated above. Pivot point 60 is comprised of sleeve 76 which is connected to lower blade attachment plate 58 and which is rotatable around axle 77; axle 77 being located at an end of scraper support plate 48. In order to change and/or resharpen blade 54, blade 54 is removed from between upper blade attachment plate 56 and lower blade attachment plate 58 by loosening bolt 75, which passes through upper blade attachment plate 56 and lower blade attachment plate 58.

Referring again to FIGS. 1 through 5, scraper support pivot plate 78 is attached to scraper support plate 48, and is connected to machine body attachment plates 80 by lower pivot point 82 or upper pivot plate 84. Connection of scraper support pivot plate 78 between lower pivot plate 82 and upper pivot plate 84 will alter the overall distance between scraper support plate 48 and the surface being removed, as well as altering the distance between scraper support plate 48 and hydraulic cylinder 42. Therefore, the configuration of scraper support plate 48 at either lower pivot plate 82 or upper pivot plate 84 by means of scraper support pivot plate 78 will alter the angle of attack of blade 54 with respect to the surface layers being removed, as will the amount of actuation of hydraulic cylinder 42, and the rotation of blade 54, upper blade attachment plate 56 and lower blade attachment plate 58 around pivot point 60, all to be described in more detail below in a discussion of FIGS. 3, 4 and 8 through 15.

Front wheel 86, which is rotatable 360° around machine body 12, is connected to wheel attachment plate 88 on machine body 12 by means of wheel flanges 90. Wheel 86 is not a drive wheel, but merely provides a third support point for surface-removing machine 10 when surface-removing machine 10 is configured in the transport position, described in further detail below. Hydraulic fluid tank 92 is located between front wheel 86 and right drive wheel 94 and left drive wheel 96 in the lower portion of machine body 12. Rear 98 of machine body 12 supports bracket 100 which contains rear weight plates 102. Rear weight plates 102 are removably securable by bolt 104. In this manner, the number of rear weight plates 102 can be altered in order to ensure that sufficient mass is present over right drive wheel 94 and left drive wheel 96 such that right drive wheel 94 and left drive wheel 96 maintain contact with the ground and have sufficient traction to propel surface-removing machine 10 forward when surface-removing machine 10 is configured in the surface scraping position, to be discussed in more detail below. Rear weight plates 102 need to be added or removed as front weight plates 52 are added or removed in order to maintain the desired center of mass of surface-removing machine 10 such that the proper balance is struck between sufficient mass over right drive wheel 94 and left drive wheel 96 to maintain traction and sufficient mass on scraper support plate 48 such that blade 54 efficiently penetrates the surface layers being removed.

Figure 5:
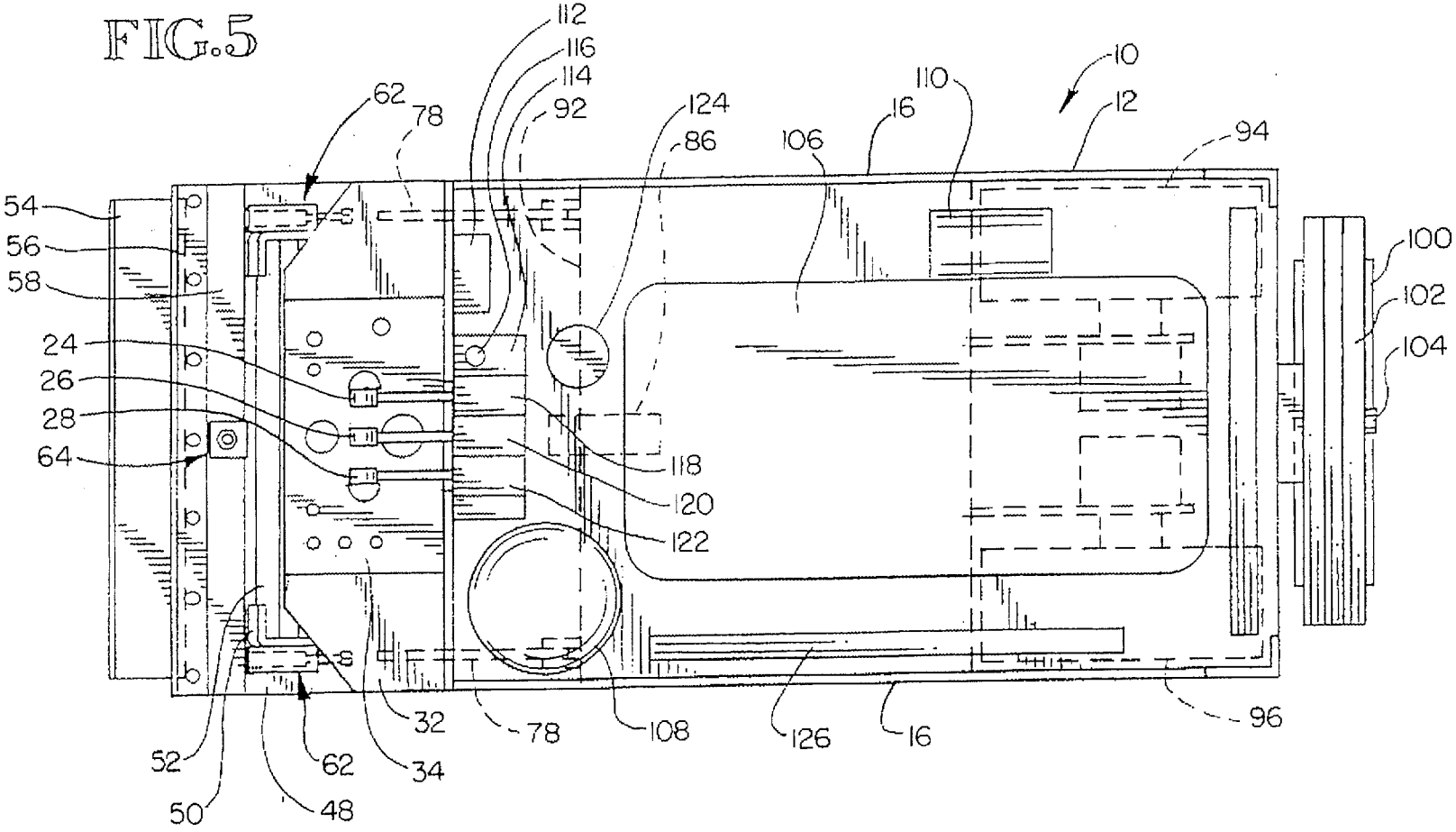
FIG. 5 is a top view, partially exposed, of the surface-removing machine of the present invention.

Referring specifically to FIGS. 5 and 23, the internal components of the surface-removing machine 10 will now be described in detail. Motor 106 provides indirect motive force for the hydraulic system powering right drive wheel 94 and left drive wheel 96 and can be an internal combustion motor powered by, for example, propane, gasoline, alcohol or an electric motor. When motor 106 is an internal combustion motor, fuel tank 108 is present. As stated above, motor 106 does not provide direct motive force for right drive wheel 94 and left drive wheel 96, but instead powers the hydraulic system which, in turn, powers right drive wheel 94 and left drive wheel 96. More specifically, right drive wheel 94 and left drive wheel 96 each include a hydraulic motor which provides the actual motive force. The hydraulic motor associated with each of right drive wheel 94 and left drive wheel 96 can be, for example, low speed, high torque wheel motor Model No. 241 manufactured by Parker Hannifin Corporation, Hydraulic Pump/Motor Division, Greeneville, Tenn. Motor 106 provides power necessary for hydraulic pump 110, which is in communication with hydraulic fluid tank 92, to circulate hydraulic fluid throughout the hydraulic system. Hydraulic pump 110 can be a hydraulic pump known in the art, for example, one of numerous hydraulic pumps manufactured by Parker Hannifin Corporation, Hydraulic Pump/Motor Division, Greeneville, Tenn. Communicating with hydraulic pump 110 is variable flow controller 112 which can be, for example, an adjustable flow control RE-175-30 manufactured by Parker Hannifin Corporation, Hydraulic Pump/Motor Division, Greeneville, Tenn. Variable flow controller 112 has hydraulic power control lever 30 thereon for control of hydraulic power by operator 0. Variable flow controller 112 has two output lines, which will be described in more detail below, which enter volume flow divider 114 having pressure limiting valve 116 therein. Volume flow divider 114 can be, for example, Part No. 20-LC-75, manufactured by Parker Hannifin Corporation, Hydraulic Pump/Motor Division, Greeneville, Tenn., and pressure limiting valve 116 can be Model No. RP51A-3000 manufactured by Parker Hannifin Corporation, Hydraulic Pump/Motor Division, Greeneville, Tenn. Volume flow divider 114 provides hydraulic fluid flow to right wheel controller 118, scraper position controller 120 and left wheel controller 122 and receives return flow therefrom, as described further below. Volume flow divider 114 also provides outlet flow to hydraulic fluid filter 124, which communicates with hydraulic fluid radiator 126. Hydraulic fluid radiator 126 communicates with hydraulic fluid tank 92, thus closing the system. Right wheel controller 118, scraper position controller 120 and left wheel controller 122 can be, for example, like elements of Model No. 20-50-04 distributed by Parker Hannifin Corporation, Hydraulic Pump/Motor Division, Greeneville, Tenn. Each of right controller 118, scraper position controller 120 and left wheel controller 122 has a line out to, and line in from, right drive wheel 94, hydraulic cylinder 42 and left drive wheel 96, respectively. In this manner, depending upon the direction of flow dictated by right wheel controller 118 and by left wheel controller 122, right drive wheel 94 and left drive wheel 96 will independently either rotate clockwise, rotate counter-clockwise, or not rotate at all. The aforesaid combination thus allows forward movement, reverse movement, left turning, right turning, and complete stop of surface-removing machine 10. Likewise, the direction of fluid flow through scraper position controller 120 dictates whether hydraulic cylinder 42 will be extended or retracted.

Now referring to FIG. 24, fluid flow through variable flow controller 112 and variable volume flow divider 114 will be described in more detail. More specifically, line L1 provides fluid flow into variable flow controller 112 from hydraulic pump 110. Presuming a 100% fluid flow through line L1, variable flow controller 112 provides variable outflow between lines L2 and L3 of from 0% through L2 and 100% through L3 to 100% through L2 and 0% through L3. The division of fluid flow between lines L2 and L3 is determined by the operator's movement of hydraulic power control lever 30 on variable flow controller 112. Thus, operation of hydraulic power control lever 30, without taking into consideration volume flow divider 114, would totally dictate the amount of hydraulic power provided to right drive wheel 94 and left drive wheel 96 and hydraulic cylinder 42. However, volume flow divider 114, and more specifically pressure limiting valve 116, provides the owner of surface-removing machine 10 with a mechanism to limit the hydraulic power available to the operator of surface-removing machine 10 regardless of the actuation of hydraulic power control lever 30 by the operator. More specifically, pressure limiting valve 116 in volume flow divider 114 limits the through flow pressure from line L2 to line L4, sending hydraulic fluid flow of a first predetermined pressure through line L6 and back to hydraulic fluid tank 92 and sending hydraulic fluid of a second predetermined pressure through line L4 and to right wheel controller 118, scraper position controller 120, and left wheel controller 122. For example, presume that hydraulic power control level 30 on variable flow controller 119. is positioned such that 60% of the fluid flow passes through line Lg. and 40% of the fluid flow passes through line L3 and into line L6 and back to the hydraulic fluid tank 99. Also presume that pressure limiting valve 116 is set such that only 50% of the maximum fluid pressure is provided to the fluid passing through line L2 and into volume flow divider 114, through line L4 and into right wheel controller 118, scraper position controller 120 and left wheel controller 122 with the remaining 50% of the pressure from line L2 being provided to the fluid to line L6 and returning to hydraulic fluid tank 92. Thus, the 60% of the hydraulic fluid entering volume flow divider 114 from line L2 will have a fluid pressure of only 50% when passed to line L4 and right wheel controller 118, scraper position 120 and left wheel controller 122. After the hydraulic fluid has passed through line L4, right wheel controller 118, scraper position 120 and left wheel controller 122 right drive wheel 94, left drive wheel 96 and hydraulic cylinder 42, it will return into volume flow divider 114 through line L5 and then pass into line L6. In this manner, line L6, like line L1, receives 100% of fluid flow. However, the fluid power actually available to the operator has been decreased by 50% due to the configuration of pressure limiting valve 116 to only allow 50% fluid pressure from line L2 to actually reach line L4, the remaining 50% being diverted to line L6. It is to be noted that the 50% configuration of pressure limiting valve 116 is only exemplary, and pressure limiting valve 116 can be configured at any percentage of between 0% and 100%.

Figure 19:
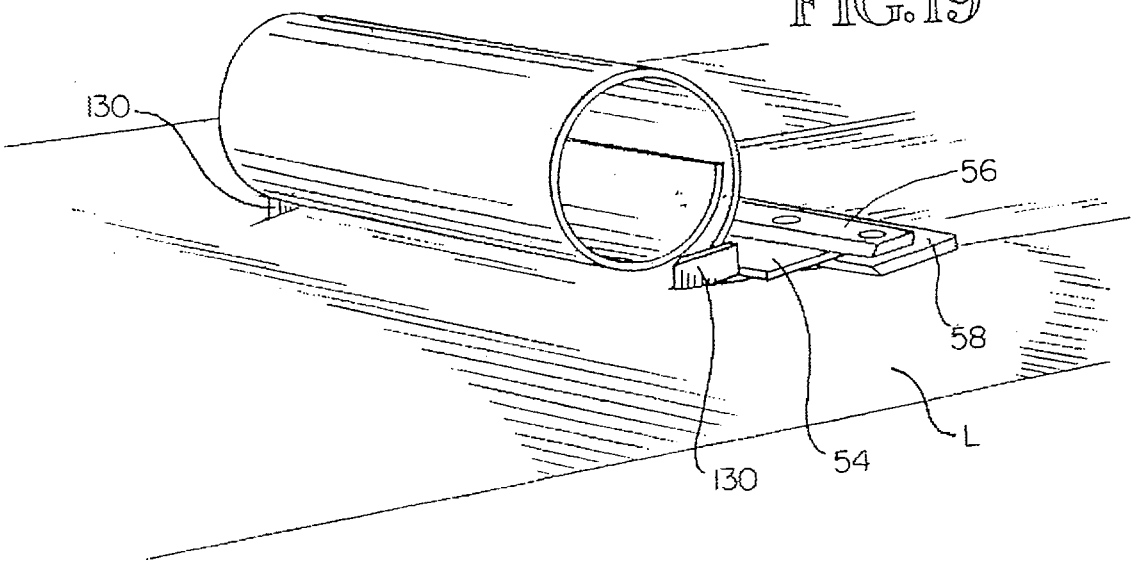
FIG. 19 is an enlarged perspective view of the blade of FIG. 18 in use.

Referring now to FIGS. 16 through 19, blade 54 is described in further detail. As shown in FIGS. 16 and 17, blade 54 can vary in both width and length, depending upon the surface to be removed. If a softer layer or layers is to be removed, a wider and longer blade is to be employed as in FIG. 16 in order to maximize the area of the surface layer that is removed with one pass of surface-removing machine 10. However, if the surface layer or layers being removed are of tougher material, or are adhered firmly to the base surface, a blade having a lesser length and width is employed, as shown in FIG. 17. The blade in FIG. 16 has a width of about three inches and a depth of about one inch, while the blade in FIG. 17 has a width of about 26 inches and a depth of about five inches. It is to be understood that the above dimensions are only exemplary and are not intended to limit the scope of the present invention. Note that the blades in FIGS. 16, 17 and 18 all have a sharpened edge 128 thereon, which is employed to enhance layer-removal as edge 128 aids the separation of two adjacent surface layers as blade 54 passes between these layers. Referring to FIG. 18, blade 54 is shown as a planar member having two side portions or wings 132 which are substantially perpendicular to the horizontal plane of blade 54. Referring to FIG. 19, wings 132 facilitate the cutting of a discrete section of the surface layer being removed and also provide guides as the surface layer L, if flexible, is rolled up during removal.

Figure 4:
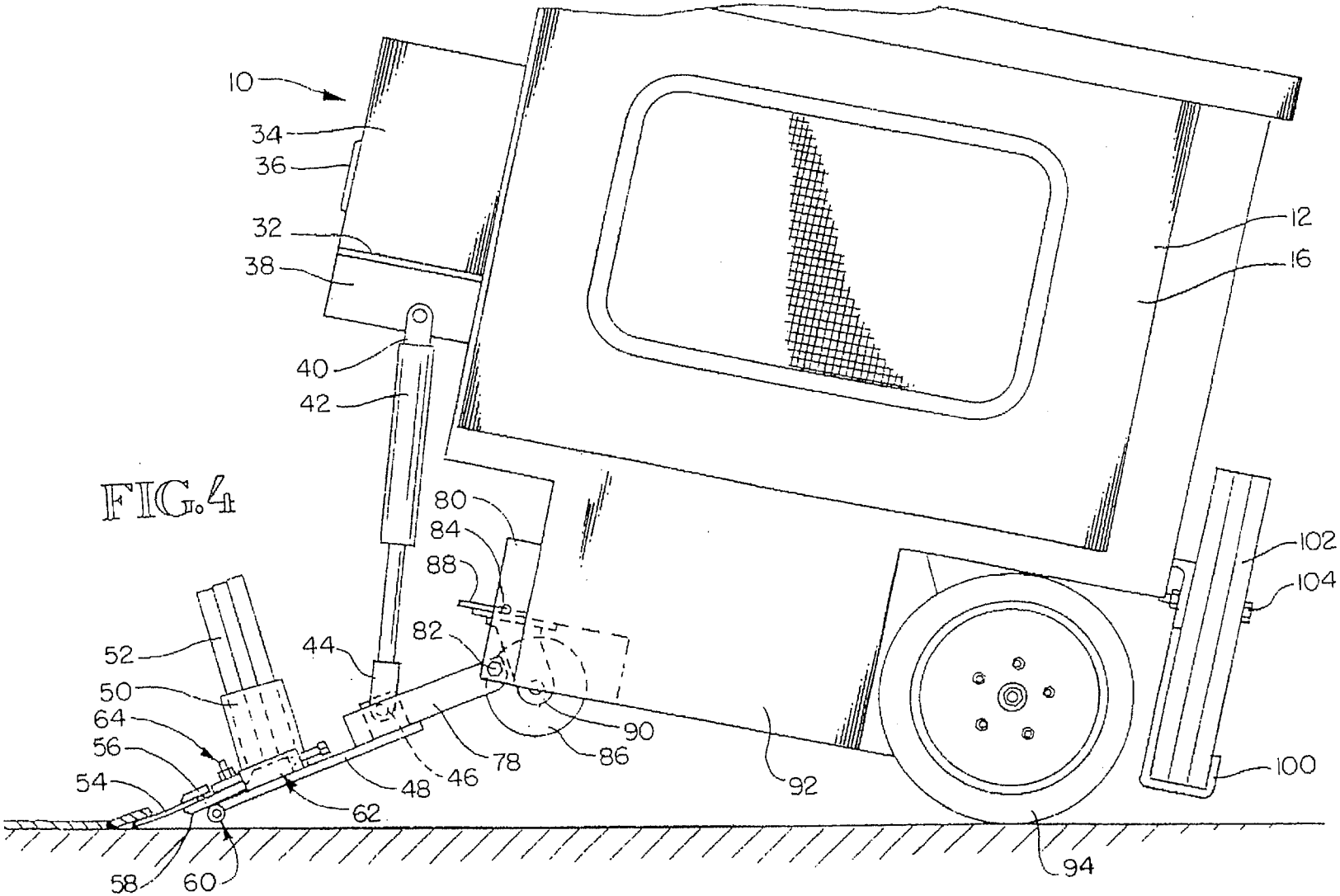
FIG. 4 is a side elevational view of the surface-removing machine of the present invention in its surface scraping position.
Figure 8:
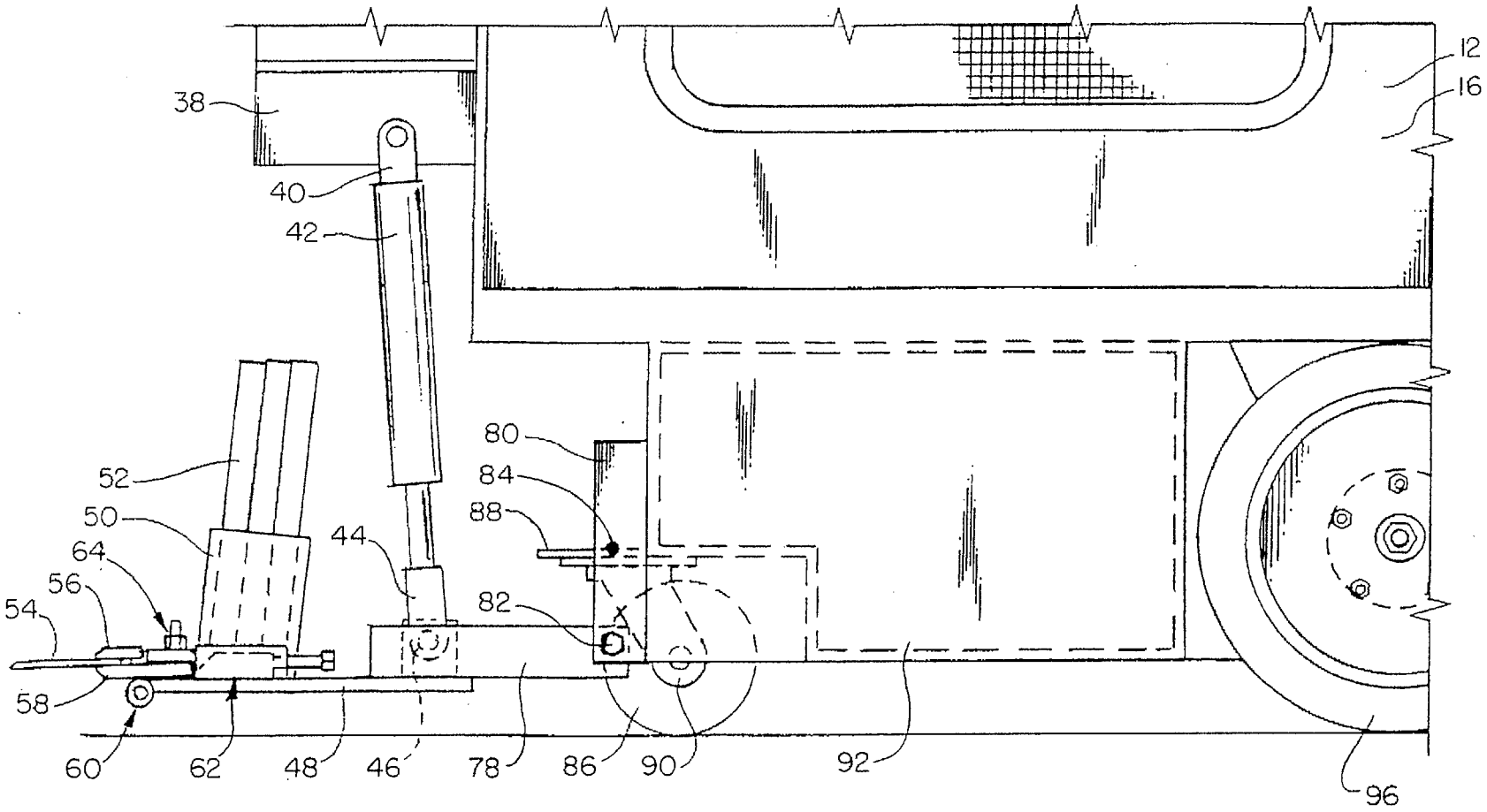
FIG. 8 is an enlarged partial side elevational view of the surface-removing machine of the present invention in a first machine transport position.
Figure 9:
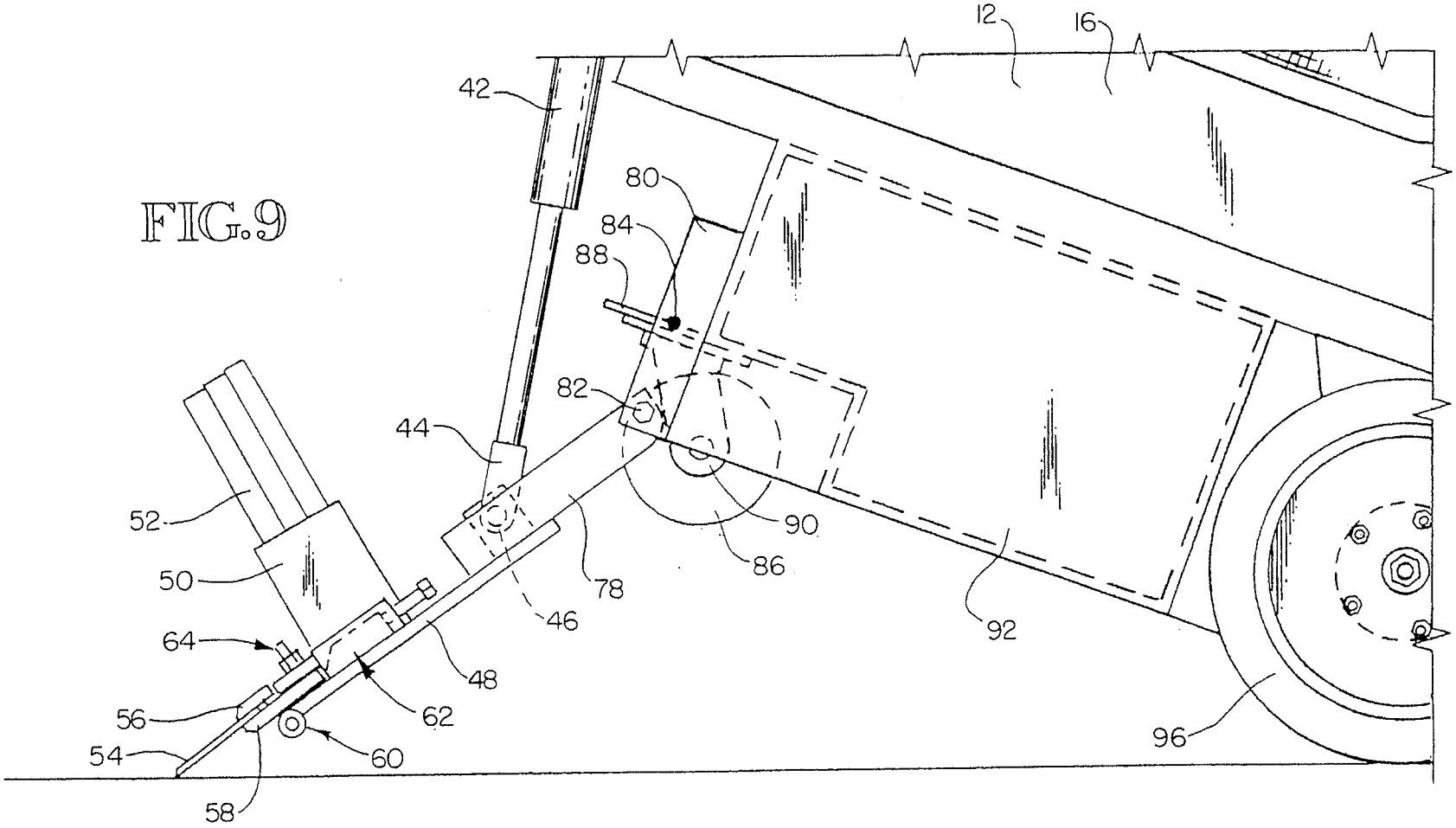
FIG. 9 is an enlarged partial side elevational view of the surface-removing machine of the present invention in a first surface scraping position.
Figure 10:
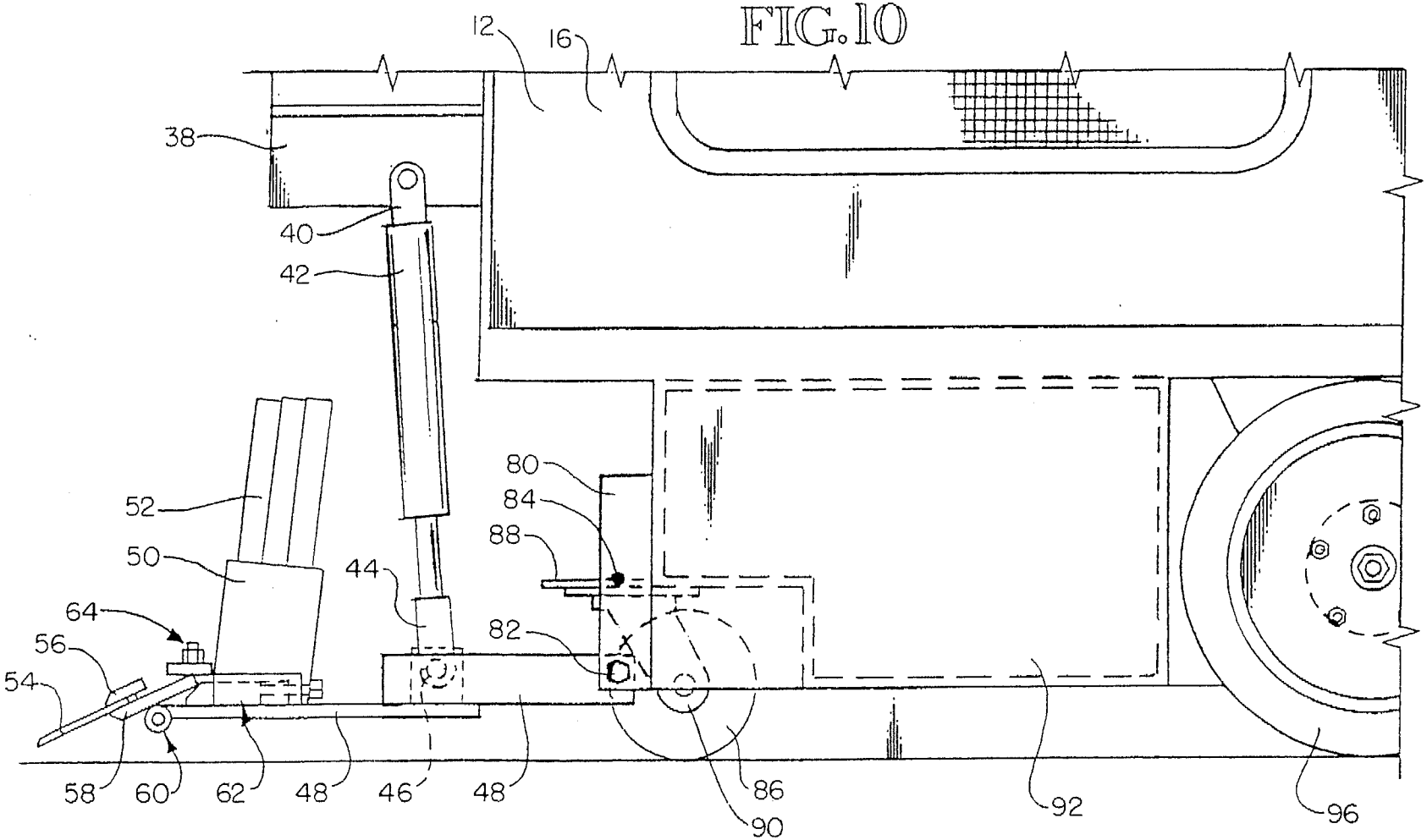
FIG. 10 is an enlarged partial side elevational view of the surface-removing machine of the present invention in a second machine transport position.
Figure 11:
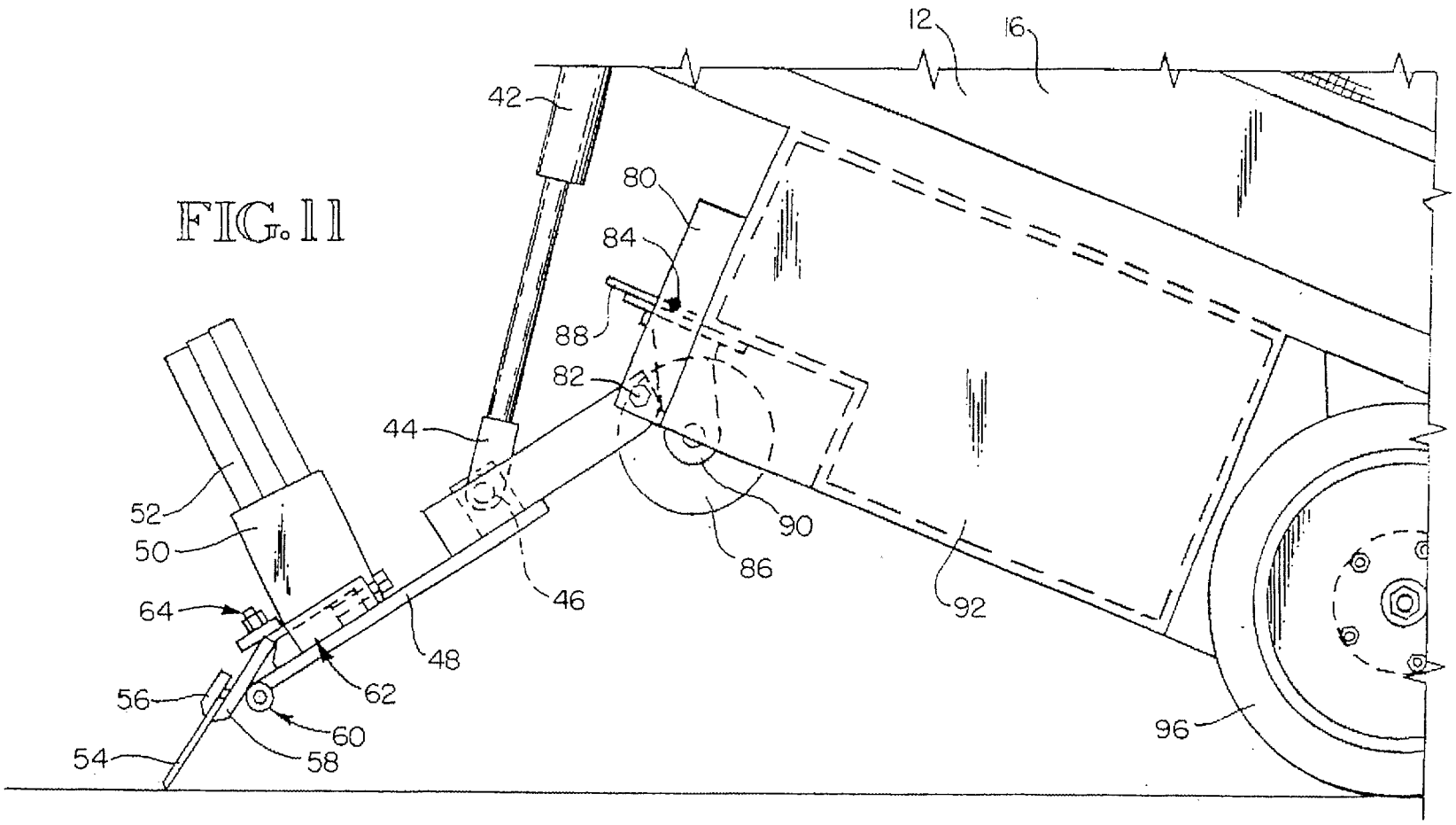
FIG. 11 is an enlarged partial side elevational view of the surface-removing machine of the present invention in a second surface scraping position.
Figure 12:
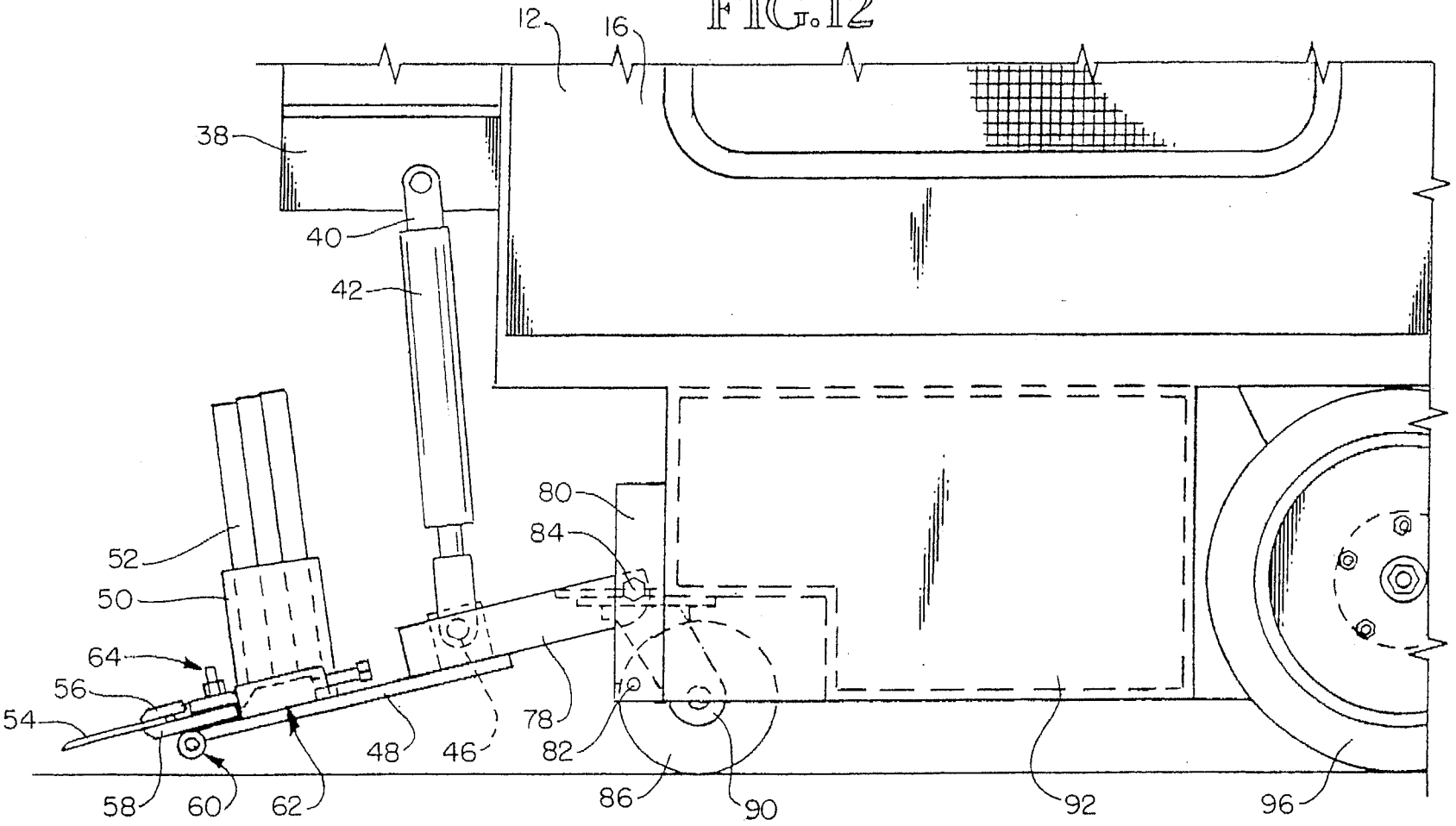
FIG. 12 is an enlarged partial side elevational view of the surface-removing machine of the present invention in a third machine transport position.
Figure 13:
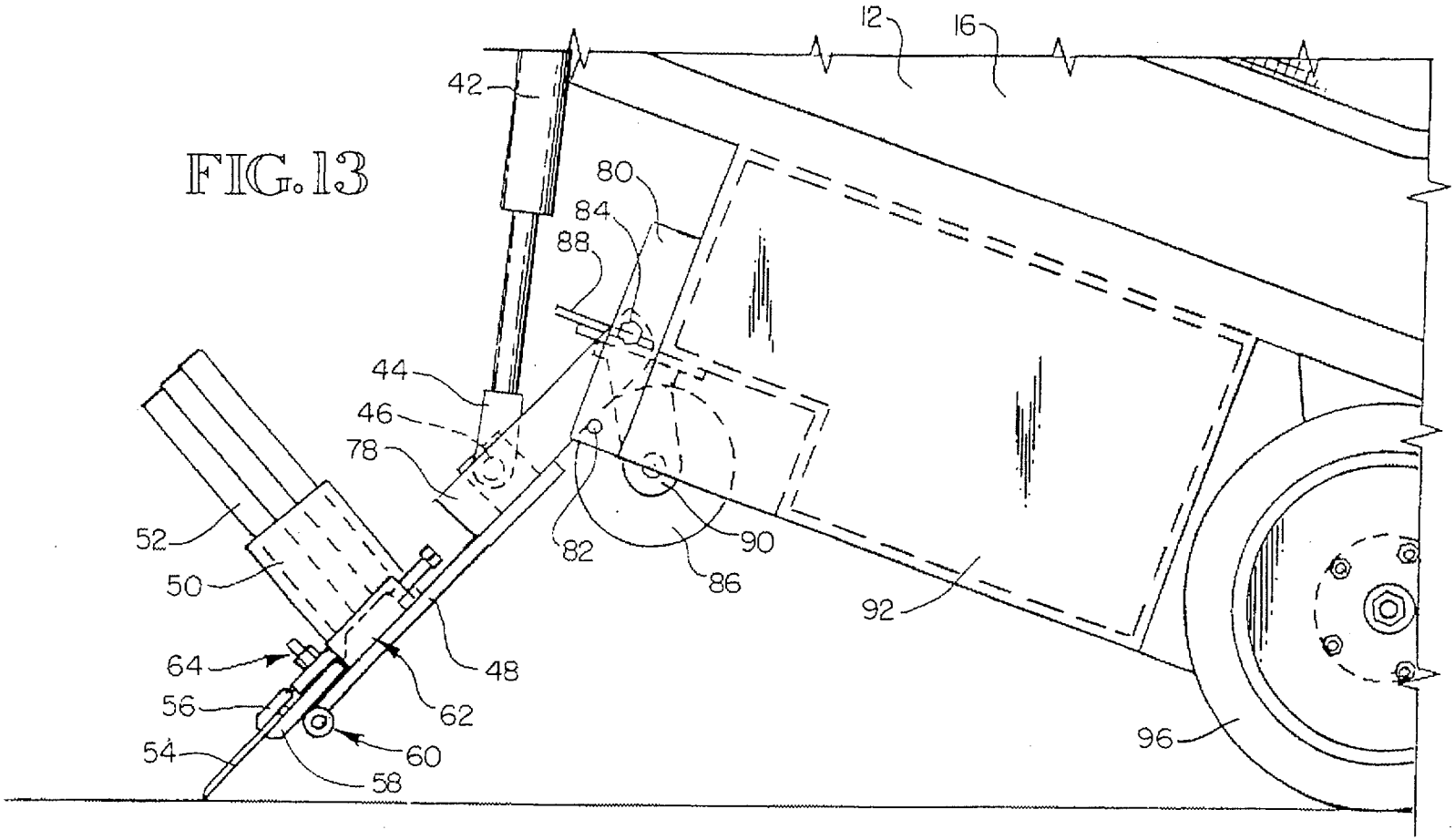
FIG. 13 is an enlarged partial side elevational view of the surface-removing machine of the present invention in a third surface scraping position.
Figure 14:
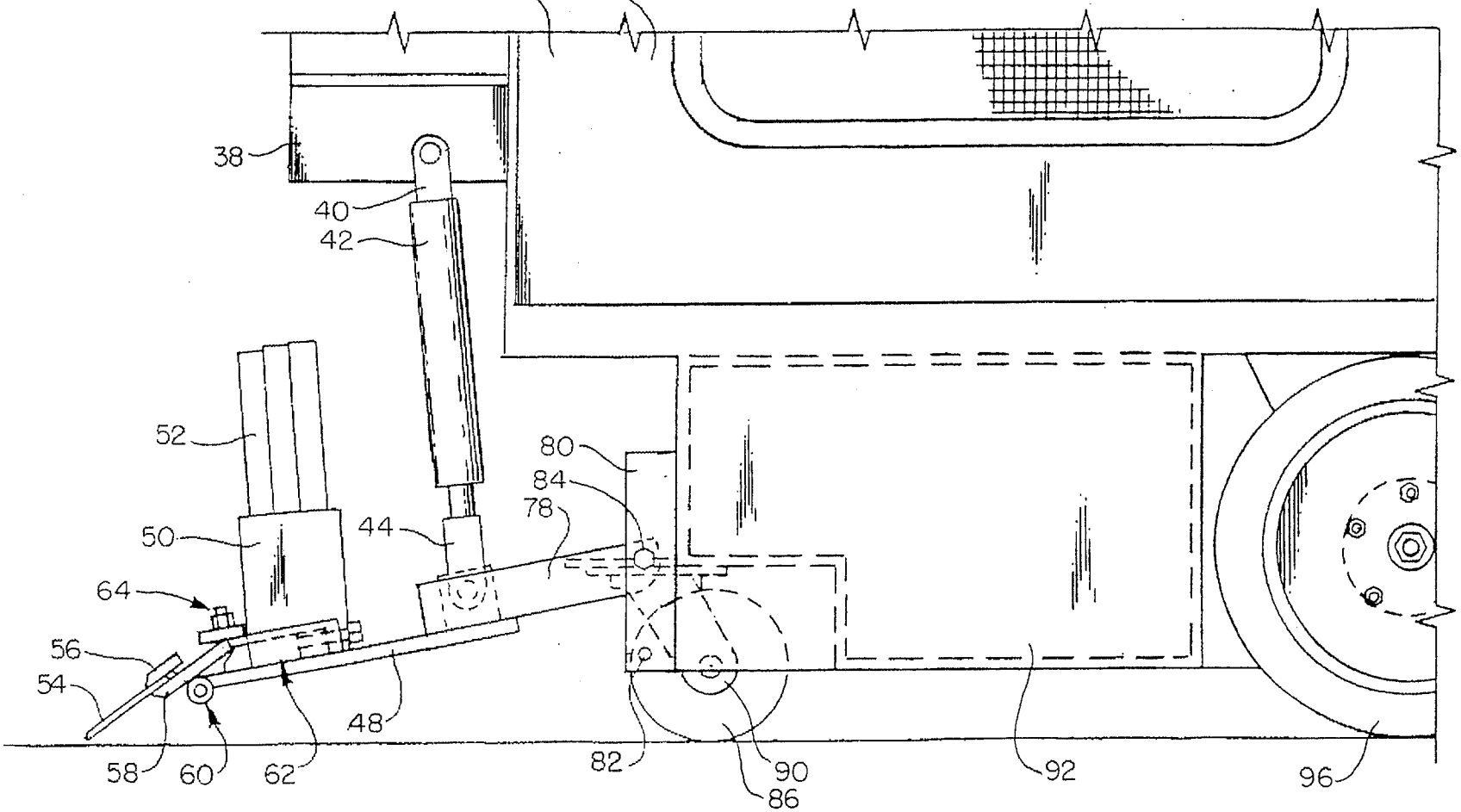
FIG. 14 is an enlarged partial side elevational view of the surface-removing machine of the present invention in a fourth machine transport position.
Figure 15:
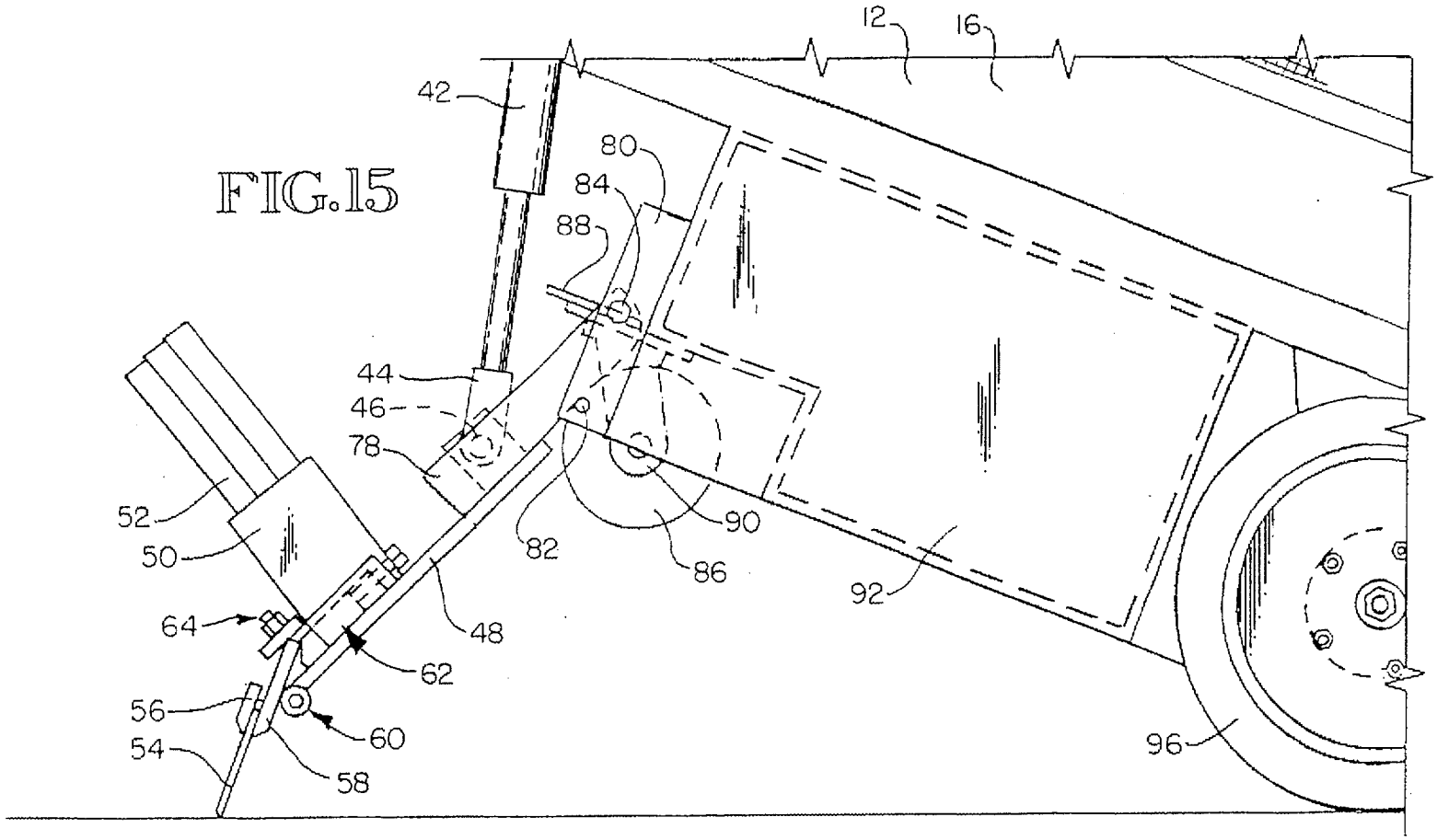
FIG. 15 is an enlarged partial side elevational view of the surface-removing machine of the present invention in a fourth surface scraping position.
Figure 20:
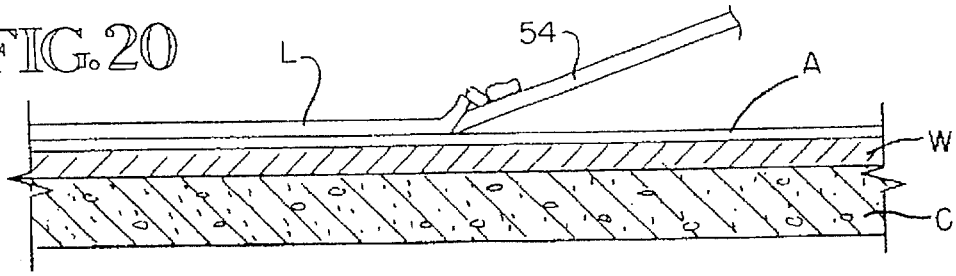
FIG. 20 is a first side view of the blade of the surface-removing machine of the present invention removing a single surface layer.
Figure 21:
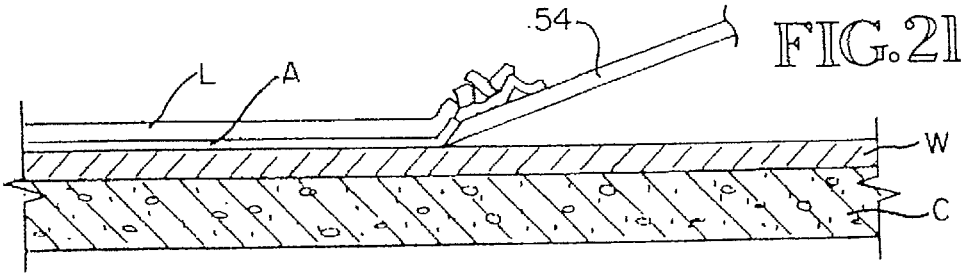
FIG. 21 is a first side view of the blade of the surface-removing machine of the present invention removing two surface layers.
Figure 22:
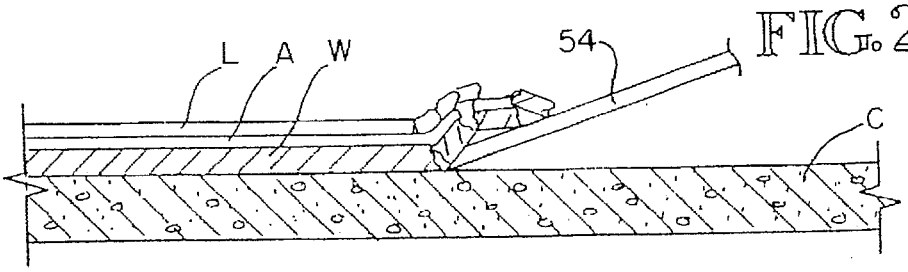
FIG. 22 is a first side view of the blade of the surface-removing machine of the present invention removing three surface layers.

Referring to FIGS. 20 through 22, an exemplary multiple layer composition is shown having a base layer of cement C on which is a layer of hardwood W, on the layer of hardwood W is a layer of adhesive A, and on the layer of adhesive A is a layer of linoleum L. FIGS. 20 through 22 illustrate some of the various layer removal possibilities available to surface-removing machine 10. FIG. 20 shows blade 54 of surface-removing machine 10 removing only top layer L, while FIG. 21 shows blade 54 of surface-removing machine 10 removing top layer L and second layer A, while FIG. 22 shows blade 54 of surface-removing machine 10 removing top layer L, second layer A, and third layer W, leaving only layer C. Which of the above three possible layer removal objectives occurs is a function of the angle of attack of blade 54 with respect to layers L, A and W. The angle of attack of blade 54 is, in turn, a function of the angle from horizontal that blade 54, upper blade attachment plate 56 and lower blade attachment plate 58 are oriented with respect to scraper support plate 48, as well as the angle from horizontal that scraper support plate 48 is located with respect to machine body 12; this second aspect being determined by whether scraper support pivot plate 78 is attached to lower pivot plate 82 or upper pivot plate 84 of machine body attachment plates 80, as well as the degree of extension or retraction of hydraulic cylinder 42. To better illustrate, reference is made to FIGS. 3, 4 and 8 through 15. FIG. 3 generally shows surface-removing machine 10 in the machine transport position where surface-removing machine 10 is moved from location to location without the removal of one or more surface layers from a floor. When surface-removing machine 10 is oriented in the machine transport position, longitudinal axis X of machine body 12 is substantially parallel with the horizontal plane of the floor. Also, in the machine transport position, blade 54 is elevated from the floor to be scraped. FIG. 4 generally shows surface-removing machine 10 in the surface scraping position, in which longitudinal axis X of machine body 12 is aparallel to the horizontal plane of the floor and blade 54 contacts one surface layer of the floor for removal. FIG. 8 shows the machine transport position (hydraulic cylinder 42 fully retracted) of surface-removing machine 10 where scraper support pivot plate 78 is located in lower pivot plate 82 of machine body attachment plates 80 and blade 54, upper blade attachment plate 56 and lower blade attachment plate 58 are configured in a parallel position with respect to scraper support plate 48. FIG. 9 shows the surface scraping position (hydraulic cylinder 42 fully extended) of surface-removing machine 10 in which scraper support pivot plate 78 is located in lower pivot plate 82 of machine body attachment plates 80 and blade 54, upper blade attachment plate 56 and lower blade attachment plate 58 are configured in a parallel position with respect to scraper support plate 48. FIG. 10 shows the machine transport position (hydraulic cylinder 42 fully retracted) of surface-removing machine 10 in which scraper support pivot plate 78 is located in lower pivot plate 82 of machine body attachment plates 80 and blade 54, upper blade attachment plate 56 and lower blade attachment plate 58 have been rotated around scraper support plate 48 to be aparallel with respect to scraper support plate 48. FIG. 11 shows the surface scraping position (hydraulic cylinder 42 fully extended) of surface-removing machine 10 in which scraper support pivot plate 78 is located in lower pivot plate 82 of machine body attachment plates 80 and blade 54, upper blade attachment plate 56 and lower blade attachment plate 58 have been rotated around scraper support plate 48 to be aparallel with respect to scraper support plate 48. FIG. 12 shows the machine transport (hydraulic cylinder 42 fully retracted) position of surface-removing machine 10 where scraper support pivot plate 78 is located in upper pivot plate 84 of machine body attachment plates 80 and blade 54, upper blade attachment plate 56 and lower blade attachment plate 58 are configured in a parallel position with respect to scraper support plate 48. FIG. 13 shows the surface scraping position (hydraulic cylinder 42 fully extended) of surface-removing machine 10 in which scraper support pivot plate 78 is located in upper pivot plate 84 of machine body attachment plates 80 and blade 54, upper blade attachment plate 56 and lower blade attachment plate 58 are configured in a parallel position with respect to scraper support plate 48. FIG. 14 shows the machine transport position (hydraulic cylinder 42 fully retracted) of surface-removing machine 10 where scraper support pivot plate 78 is located in upper pivot plate 84 of machine body attachment plates 80 and blade 54, upper blade attachment plate 56 and lower blade attachment plate 58 have been rotated around scraper support plate 48 such that blade 54, upper blade attachment plate 56 and lower blade attachment plate 58 are aparallel with respect to scraper support plate 48. FIG. 15 shows surface-removing machine 10 configured in the surface scraping position (hydraulic cylinder 42 fully extended) where scraper support pivot plate 78 is located in upper pivot plate 84 of machine body attachment plates 80 and blade 54, upper blade attachment plate 56 and lower blade attachment plate 58 have been rotated around scraper support plate 48 such that blade 54, upper blade attachment plate 56 and lower blade attachment plate 58 are aparallel with respect to scraper support plate 48.

It is to be understood that the pairs of FIGS. 8 and 9, FIGS. 10 and 11, FIGS. 12 and 13, and FIGS. 14 and 15 each show the two most opposite configurations of surface-removing machine 10, and that surface-removing machine 10 can be configured in any position between each of these two opposite configurations based on the amount of extension of hydraulic cylinder 42.

While particular embodiments of the present invention have been described in some detail herein above, changes and modifications may be made in the illustrated embodiments without departing from the spirit of the invention.

I claim:

1. An apparatus for removing at least one surface layer from a floor or the like comprising:

a machine body;

rear weight-bearing drive means;

front weight-bearing wheel means;

front weight-bearing support plate pivotally attached to said machine body at a first location on said machine body, said support plate having a scraping blade attached thereto;

means for pivoting said support plate and scraping blade between a first machine transport position in which said front weight-bearing wheel means contacts the surface being scraped and said scraping blade is elevated from the surface being scraped, and a second surface scraping position in which said front weight-bearing wheel means is elevated from the surface being scraped and said scraping blade contacts the surface being scraped;

a hydraulic cylinder having two ends, the first end connected to said machine body at a second location on said machine body which is substantially above said first location and. the second end being substantially below said first end connected to said support plate.

2. The apparatus of claim 1 wherein said machine body has a rear portion with a plurality of removable weights located thereon.

3. The apparatus of claim 1 wherein said support plate has a plurality of removable weights located thereon.

4. The apparatus of claim 1 wherein said machine body is mountable by a machine operator during operation.

5. The apparatus of claim 1 wherein said support plate is adjustable between said first location on said machine body and a third location on said machine body such that the distance from the floor to said support plate at its attachment to said machine body is altered.

6. The apparatus of claim 1 wherein said support plate further comprises means for pivotally attaching said blade to said support plate.

7. The apparatus of claim 6 wherein said support plate has an end and said means for pivotally attaching said blade to said support plate comprises:

a blade attachment plate pivotally attached adjacent said end of said support plate;

a wedge slidably mounted on said support plate and oriented to fit under a portion of said blade attachment plate to bias said blade attachment plate at a predetermined angle from horizontal; and means for securing said blade attachment plate against said wedge.

8. The apparatus of claim 1 wherein said scraping blade is a planar member having a front scraping portion connected to two side portions, said two side portions being substantially perpendicular to the horizontal plane of said scraping blade.

9. An apparatus for removing at least one surface layer from a floor or the like comprising:

a machine body;

rear weight-bearing drive means;

front weight-bearing wheel means;

front weight-bearing support plate pivotally attached to said machine body at a first location on said machine body, said support plate having a scraping blade attached thereto;

means for pivoting said support plate and scraping blade between a first machine transport position in which said front weight-bearing wheel means contacts the surface being scraped and said scraping blade is elevated from the surface being scraped, and a second surface scraping position in which said front weight-bearing wheel means is elevated from the surface being scraped and said scraping blade contacts the surface being scraped;

wherein said support plate is adjustable between said first location on said machine body and a second location on said machine body such that the distance from the floor to said support plate at its attachment to said machine body is altered.

10. The apparatus of claim 9 wherein said machine body has a rear portion with a plurality of removable weights located thereon.

11. The apparatus of claim 9 wherein said support plate has a plurality of removable weights located thereon.

12. The apparatus of claim 9 wherein said machine body is mountable by a machine operator during operation.

13. The apparatus of claim 9 wherein said means for pivoting said front weight-bearing scraping means is a hydraulic cylinder.

14. The apparatus of claim 9 wherein said support plate further comprises means for pivotally attaching said blade to said support plate.

15. The apparatus of claim 14 wherein said support plate has an end and said means for pivotally attaching said blade to said support plate comprises:

a blade attachment plate pivotally attached adjacent said end of said support plate;

a wedge slidably mounted on said support plate and oriented to fit under a portion of said blade attachment plate to bias said blade attachment plate at a predetermined angle from horizontal; and means for securing said blade attachment plate against said wedge.

16. The apparatus of claim 9 wherein said scraping blade is a planar member having a front scraping portion connected to two side portions, said two side portions being substantially perpendicular to the horizontal plane of said scraping blade.

17. An apparatus for removing at least one surface layer from a floor or the like comprising:

a machine body;

rear weight-bearing drive means;

front weight-bearing wheel means;

front weight-bearing scraping means pivotable with respect to said machine body and having a blade thereon;

means for pivotally attaching said blade to said front weight-bearing scraping means; and means for pivoting said front weight-bearing scraping means between a first machine transport position in which said front weight-bearing wheel means contacts the surface being scraped and said front weight-bearing scraping means is elevated from the surface being scraped and a second surface scraping position in which said front weight-bearing wheel means is elevated from the surface being scraped and said front weight-bearing scraping means contacts the surface being removed wherein said front weight-bearing scraping means has a front end and further comprises:

a blade attachment plate pivotally attached adjacent said front end;

a wedge slidably mounted on said front end and oriented to fit. under a portion of said blade attachment plate to bias said blade attachment plate at a predetermined angle from horizontal; and means for securing said blade attachment plate against said wedge.

18. The apparatus of claim 17 wherein said machine body has a rear portion with a plurality of removable weights located thereon.

19. The apparatus of claim 17 wherein said machine body is mountable by a machine operator during operation.

20. The apparatus of claim 17 wherein said means for pivoting said front weight-bearing scraping means is a hydraulic cylinder.

21. The apparatus of claim 17 wherein said front weight-bearing scraping means has a plurality of removable weights located thereon.

22. The apparatus of claim 17 wherein said means for pivoting said front weight-bearing scraping means is a hydraulic cylinder and said front weight-bearing scraping means comprises a support plate pivotally attached to said machine body at a first location on said machine body, said hydraulic cylinder being connected between said machine body and said support plate and connected to said machine body at location substantially above said support plate.

23. The apparatus of claim 22 wherein said support plate is-adjustable between said first location on said machine body and a second location on said machine body such that the distance from the floor to said support plate at its connection to said machine body is altered.

24. The apparatus of claim 17 wherein said scraping blade is a planar member having a front scraping portion connected to two side portions, said two side portions being substantially perpendicular to the horizontal plane of said scraping blade.

* * * * *

US005641206C1

(12) EX PARTE REEXAMINATION CERTIFICATE (10818th)

United States Patent
Craft

(10) Number: US 5,641,206 C1
(45) Certificate Issued: Feb. 19, 2016

(54) APPARATUS FOR REMOVING A SURFACE LAYER FROM A FLOOR OR THE LIKE

(75) Inventor: David B. Craft, Soap Lake, WA (US)

(73) Assignee: INNOVATECH PRODUCTS & EQUIPMENT CO., Bothell, WA (US)

Reexamination Request:
No. 90/013,434, Jan. 30, 2015

Reexamination Certificate for:
Patent No.: 5,641,206
Issued: Jun. 24, 1997
Appl. No.: 08/516,154
Filed: Aug. 17, 1995

(51) Int. Cl.
*E21C 25/00* (2006.01)
*E04G 23/00* (2006.01)

(52) U.S. Cl.
CPC ..... *E04G 23/006* (2013.01)

(58) Field of Classification Search
None
See application file for complete search history.

(56) References Cited

To view the complete listing of prior art documents cited during the proceeding for Reexamination Control Number 90/013,434, please refer to the USPTO's public Patent Application Information Retrieval (PAIR) system under the Display References tab.

*Primary Examiner* — Robert M Fetsuga

(57) ABSTRACT

An apparatus for removing at least one surface layer from a floor or the like comprises a machine body having a longitudinal axis, rear weight-bearing guide wheels, and a front weight-bearing wheel. A front weight-bearing scraping apparatus is pivotable with respect to the machine body by a cylinder located between the machine body and the front weight-bearing scraping apparatus. The machine body is thus configurable between a first machine transport position in which the front weight-bearing wheel contacts the surface being scraped and the front weight-bearing scraping apparatus is elevated from the surface being scraped and the longitudinal axis of the machine body is substantially parallel with the horizontal plane of the surface being scraped; and a second surface-scraping position in which the front weight-bearing wheel is elevated from the surface being scraped and the front weight-bearing scraping apparatus contacts the surface being scraped and the longitudinal axis of the machine body is aparallel to the horizontal plane of the surface being scraped.

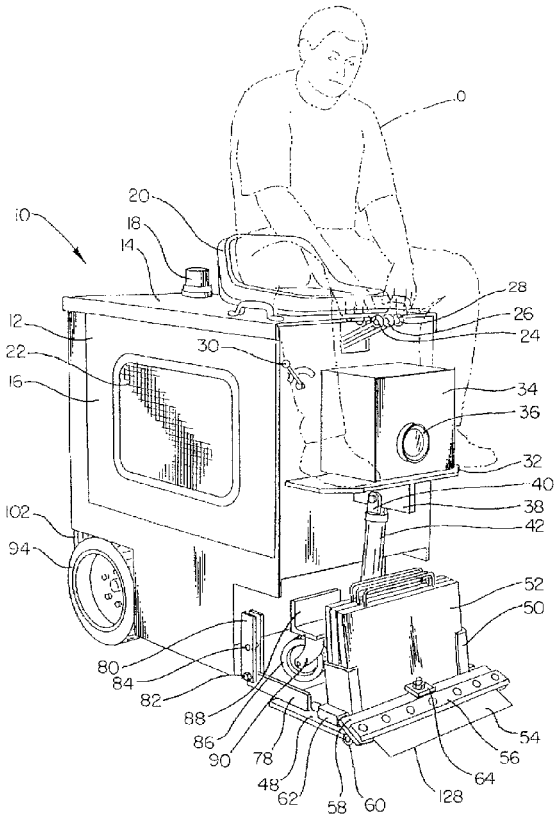

EX PARTE REEXAMINATION CERTIFICATE

THE PATENT IS HEREBY AMENDED AS INDICATED BELOW.

AS A RESULT OF REEXAMINATION, IT HAS BEEN DETERMINED THAT:

Claims 1, 2, 4, 5, 8-10, 12, 13 and 16 are cancelled.

Claims 3, 6, 7, 11, 14, 15 and 17-24 were not reexamined.

* * * * *